United States Patent [19]

Grossman

[11] Patent Number: 4,487,616

[45] Date of Patent: Dec. 11, 1984

[54] METHOD FOR REMOVING SOLVENT FROM SOLVENT VAPOR-LADEN AIR EXITING A DRY-CLEANING MACHINE

[75] Inventor: Bruce M. Grossman, Chicago, Ill.

[73] Assignee: Scrub-Tek, Inc., Chicago, Ill.

[21] Appl. No.: 476,971

[22] Filed: Mar. 21, 1983

Related U.S. Application Data

[63] Continuation of Ser. No. 314,791, Oct. 26, 1981, abandoned.

[51] Int. Cl.[3] ..... B01D 47/00

[52] U.S. Cl. ..... 55/85; 55/90; 55/233; 55/241; 55/228; 68/18 C; 261/98; 261/112

[58] Field of Search ..... 55/84, 85, 90–94, 55/233, 241, 228; 68/18 C; 261/94–98, 112; 34/77; 8/142

[56] References Cited

U.S. PATENT DOCUMENTS

| | | | |
|---|---|---|---|
| 1,977,107 | 10/1934 | Agronofsky | 55/86 |
| 2,057,579 | 10/1936 | Kurth | 55/233 |
| 3,232,029 | 2/1966 | Evans | 55/83 |
| 3,290,025 | 12/1966 | Engalitcheff | 261/112 |
| 3,607,617 | 9/1971 | Drew | 55/80 |
| 3,800,505 | 4/1974 | Tarves | 55/93 |
| 4,157,250 | 6/1979 | Regehr | 55/257 PV |
| 4,217,115 | 8/1980 | Palmer | 55/89 |
| 4,252,546 | 2/1981 | Krugman | 55/85 |

FOREIGN PATENT DOCUMENTS

| | | | |
|---|---|---|---|
| 118329 | 4/1944 | Australia | 68/18 R |
| 316891 | 12/1949 | Fed. Rep. of Germany | 55/90 |
| 2511181 | 9/1976 | Fed. Rep. of Germany | 55/90 |
| 2854763 | 7/1980 | Fed. Rep. of Germany | 68/18 C |

*Primary Examiner*—Bernard Nozick

*Attorney, Agent, or Firm*—Kinzer, Plyer, Dorn & McEachran

[57] ABSTRACT

A method for recovering hydrocarbon and hydrocarbon derived solvents from solvent laden air. This method includes the steps of moving the solvent laden air through a first chamber; moving a film of liquid coolant, which liquid coolant is cooled to a temperature at least as low as 20° F. and is immiscible with the solvent to be recovered, over plates located in the first chamber in contact with the solvent laden air, thereby condensing the solvent on the film of liquid coolant moving over the plates; collecting the immiscible liquid coolant and condensed solvent; and separating the immiscible liquid coolant from the condensed solvent. The liquid coolant may be moved through the first chamber in a direction counter to the direction of movement of the solvent laden air. The solvent may be a dry cleaning solvent and the liquid coolant may be a brine solution. More specifically, the solvent may be perchloroethylene and the liquid coolant may be a brine solution of calcium chloride.

7 Claims, 6 Drawing Figures

METHOD FOR REMOVING SOLVENT FROM SOLVENT VAPOR-LADEN AIR EXITING A DRY-CLEANING MACHINE

This application is a continuation of application Ser. No. 314,791, filed Oct. 26, 1981, now abandoned.

BACKGROUND OF THE INVENTION

1. Field of the invention

The present invention relates to a method and apparatus for removing solvent from solvent vapor-laden air. More specifically, the present invention relates to a method and apparatus utilizing scrubbing and condensing techniques for removing liquid hydrocarbons such as a solvent from vapor-laden air such as perchlorethylene from air exiting from a conventional dry-cleaning machine.

2. Description of the Prior Art

Heretofore, many methods and apparatus have been proposed for treating a fluid such as a gas to remove hydrocarbon vapors such as oil vapor or solvent vapor therefrom. Examples of such previously proposed methods and apparatus employing scrubbing of a gas and condensing of a hydrocarbon liquid vapor therein such as a solvent, are disclosed in the following U.S. Patents:

| U. S. Pat. No. | Patentee |
|---|---|
| 741,855 | Vollmann |
| 877,520 | Schmaltz |
| 2,220,219 | Crawford |
| 3,800,505 | Tarves, Jr. |
| 3,927,153 | Tarhan |
| 4,044,078 | Curtis, et al. |
| 4,098,854 | Knirsch, et al. |
| 4,121,541 | Kneissl, et al. |

Also, it has heretofore been proposed to pass solvent vapor-laden air from a dry-cleaning machine through an apparatus or device for removing solvent from the air. Examples of such heretofore proposed devices and machines for removing solvent from solvent vapor-laden air exiting from a dry-cleaning machine are disclosed in the following U.S. Patents:

| U. S. Pat. No. | Patentee |
|---|---|
| 3,807,948 | Moore |
| 4,083,704 | Knopf |

As will be explained in greater deal in connection with the description of the method and apparatus of the present invention, the method and apparatus of the present invention differ from the previously proposed methods and apparatus by providing for the spraying of a coolant over a condensing medium having coolant therein while passing solvent vapor-laden air upwardly through the condensing medium to condense the solvent vapor into the condensing liquid coolant.

Also, to improve the efficiency of the method and apparatus of the present invention, such method and apparatus can provide for enhanced heat transfer of heat from the solvent vapor-laden air prior to passing the solvent vapor-laden air through the condensing medium. This is accomplished by first passing the heated solvent vapor-laden air upwardly through a cooling chamber wherein water is sprayed into the chamber; and by means of an extended surface non-wetting packing, the heat transfer to droplets of water in the cooling chamber from the solvent vapor-laden air is enhanced.

The liquid mixture of coolant and solvent is fed to a separator/reservoir where the solvent is separated from the coolant, the coolant is recooled for reuse and the solvent is drained off for reuse.

SUMMARY OF THE INVENTION

According to the invention there is provided a method for removing vaporized liquid such as a solvent from vapor laden gas such as air comprising the steps of: establishing a closed condensing chamber having a gas/air inlet at the bottom, a drain at the bottom and a gas/air outlet at the top; providing extended surface area condensing means in the chamber; spraying a condensing liquid coolant into the top of the chamber in a downward direction over the extended surface area condensing means; feeding vapor-laden gas into the bottom of the chamber; passing the vapor laden gas upwardly through the chamber and past films of coolant on the condensing means; condensing the vapor, e.g., solvent vapor, with and into the condensing liquid coolant; draining the mixture of coolant and condensed liquid, e.g., solvent, from the chamber and exhausting substantially vapor/solvent free gas/air from the top of the chamber.

Also according to the invention there is provided a method for first cooling the solvent vapor-laden air comprising: establishing a cooling chamber with an air inlet at the bottom, a drain at the bottom, and an air outlet at the top; providing an extended surface non-wetting packing in the chamber; spraying tap water into the top of the chamber in a downward direction, said water spray being deflected in tiny droplets by the packing; feeding solvent vapor laden air into the bottom inlet; passing the solvent vapor laden air upwardly through the chamber past the extended surface packing and in contact with water droplets in the chamber; and exhausting cooled solvent vapor laden air from the top of the cooling chamber so said cooled solvent vapor laden air can be directed to the bottom of said condensing chamber.

Further according to the invention there is provided an apparatus for removing a vaporized liquid such as a solvent from vapor-laden gas such as air comprising a closed condensing chamber having a gas/air inlet at the bottom, a drain at the bottom, and a gas/air outlet at the top; extended surface area condensing means in said chamber; a spray nozzle at the top of said chamber for spraying a condensing liquid coolant into said chamber in a downward direction over said extended surface area condensing means; means for feeding vapor-laden gas to said bottom inlet so that said vapor-laden gas can travel upwardly through said chamber and past films of coolant on said condensing means to condense said vapor with and into said condensing liquid coolant; means for draining the mixture of coolant and condensed liquid, e.g., solvent, from said drain at said bottom of said chamber and means for exhausting substantially vapor-free gas from the top of said chamber.

Still further according to the invention there is provided apparatus for first cooling the solvent vapor-laden air comprising a closed cooling chamber having an air inlet at the bottom, a drain at the bottom, and an air outlet at the top; an extended surface non-wetting packing positioned in said chamber; a spray nozzle at the top of said chamber for spraying tap water into said chamber in a downward direction, said water spray being deflected in tiny droplets by said packing; means for feeding solvent vapor-laden air to said bottom inlet so that the solvent vapor-laden air flows upwardly through the chamber past the extended surface packing and in contact with water droplets in said chamber; and means for exhausting cooled solvent vapor-laden air from the top of said chamber which can them be directed to said condensing chamber.

Still further, according to the invention there is provided a method for removing solvent from hot solvent vapor-laden air comprising the steps of: cooling the solvent vapor-laden air; condensing the solvent vapor in the air with a cooled liquid coolant; separating the solvent from the coolant for reuse; and, cooling the liquid coolant for reuse as a condensing medium.

And still further, according to the invention there is provided apparatus for removing solvent from hot solvent vapor-laden air comprising: means for cooling the solvent vapor-laden air; means for condensing the solvent vapor in the air with a cooled liquid coolant; means for separating the solvent from the coolant for reuse; and means for cooling the liquid coolant for reuse as a condensing medium.

DESCRIPTION OF THE PREFERRED EMBODIMENT(S)

Figure 1:
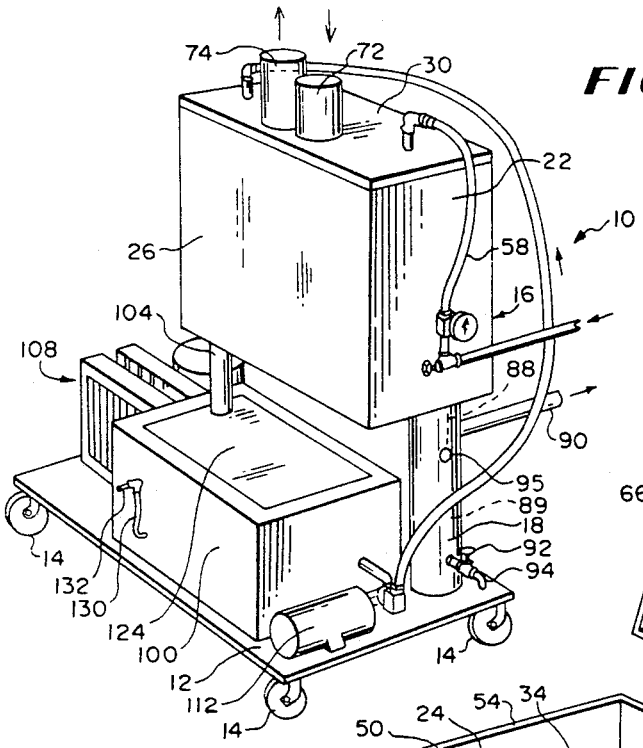
FIG. 1 is a perspective view of the apparatus of the present invention mounted on a movable platform.

Referring now to the drawings in greater detail, there is illustrated in FIG. 1 an apparatus 10 which is made in accordance with the teachings of the present invention and which is adapted for processing solvent vapor-laden air (on any vapor laden gas) therethrough for the purpose of removing the vapor (or solvent) from the gas (air) and exhausting gas (air) into the ambient environment.

Such apparatus 10 is particularly adapted for being connected to and combined with a dry-cleaning machine or a series of machines (not shown). In this respect, the heated air leaving a dry-cleaning machine is heavily laden with solvent such as perchlor ethylene which is deleterious to the environment and can be harmful to mankind. In this respect, many hydrocarbons, such as found in solvent and related chemicals have been found to be carcinogenic.

Accordingly, the apparatus 10 and the method of the present invention practiced therewith are particularly directed to improving the quality of life on this planet.

Also, by removing the solvent from the solvent vapor-laden air, one is able to reuse the solvent. As a result there is an economic benefit to be obtained by owners and operators of dry-cleaning machines in using the apparatus of the present invention. Thus, by interposing the apparatus 10 of the present invention between the air outlet of a dry-cleaning machine and the ambient environment, one not only cleans the air so that very little solvent is being emitted into the atmosphere, but one also is able to reclaim and reuse the solvent removed from the solvent vapor-laden air for reuse in dry-cleaning machines.

Referring again to FIG. 1, the apparatus 10 is mounted on a platform 12 having four casters 14 on the bottom thereof so that the apparatus 10 can be easily positioned wherever desired in a dry-cleaning plant.

On the platform 14, there is supported a housing 16 of the apparatus 10. The main support for the housing 16 is a hollow cylindrical column 18 which is situated at one corner of the platform 14.

The housing 16 is generally rectangular in shape and has a bottom wall 20, first and second end walls 22 and 24, and first and second side walls 26 and 28. The top of the housing 16 is open and is adapted to receive a cover 30 thereover which will be described in greater detail below.

Between the side walls 26 and 28 of the housing 16 and spaced from the end walls 22 is a first partition wall 32. Similarly, between the side walls 26 and 28 and spaced from the end wall 24 is a second partition wall 34. The partition walls 32 and 34 are spaced from each other and the space therebetween is divided by a short width partition wall 36 into an air inlet receiving duct 38 and a cooled-air transfer duct 40.

A lower bottom corner of the first partition wall 32 is cut away to form an inlet opening 42 which communicates the inlet duct 38 with a cooling chamber 44 defined between the end wall 22 and the first partition wall 32. Catty corner from the opening 42, a top corner of the partition wall 32 is cut away to form an outlet opening 46 to the transfer duct 40 from the cooling chamber 44.

A lower bottom corner of the second partition wall 34 adjacent the air transfer duct 40 is cut away to form an inlet opening 48 through the second partition wall 34 into a condensing chamber 50.

In the cooling chamber 44 hot solvent vapor-laden air passing therethrough is cooled and then fed to the condensing chamber 50 where solvent in the solvent vapor-laden air is condensed to a liquid and removed from the chamber 50 and substantially solvent free air is vented to atmosphere.

The top cover 30 for the housing 16 has a depending skirt or flange 52 for being received about a top edge 54 of the housing 16. Mounted in the top cover 30 (which forms a top wall of the housing 16) is a first spray nozzle 56 which can be a wide angle square spray nozzle of the type sold by Spraying Systems Co. of Wheaton, Ill. The spray nozzle 56 is supplied by a conduit 58 which is connected through a pressure gauge 60 and a valve 62 to a tap water inlet pipe 64. The spray nozzle 56 is positioned to spray tap water into the cooling chamber 44.

A second spray nozzle 66, which can be idential to the spray nozzle 56, is provided for spraying a coolant into the condensing chamber 50.

The second spray nozzle 66 is also mounted in the cover 30. The spray nozzle 66 is connected to a flexible conduit 67 which is connected to a source of coolant.

Also in the cover 30 is an inlet port 68 and an outlet port 70. The inlet port 68 is positioned so as to be located over the top of the inlet duct 38 and the outlet port 70 is positioned to open into the condensing chamber 50.

A short cylindrical duct-forming inlet sleeve 72 is mounted to the inlet port 68 and extends upwardly from the cover 30. Likewise, a similar short cylindrical duct-forming sleeve 74 is mounted to and extends upwardly from the outlet port 70.

In the bottom of the cooling chamber 44 is a screen 76. Above the screen 76 there is situated pieces 78 of extended surface, non-wetting packing 80. Each piece of packing 80 consists of a short stem 82 made of metal wire or thermoplastic material and has a plurality of radially extending theremoplastic tines 84 extending therefrom. Such packing 80 is sold under the trademark "Brush Pack ESP" by Beco Engineering Company of Glenshaw, Pa. The thermoplastic tines 84 of the pieces 78 of packing 80 are non-wetting and water droplets making contact with these tines 84 easily roll of them into the ambient environment. This is much like water rolling off a thermoplastic material of the type sold under the trademark Teflon. The pieces 78 of packing 80 are much like artificial evergreen tree branches in shape and configuration.

It will be appreciated that the inlet sleeve 72 is connected via a flexible conduit or sheet metal duct to the outlet of a dry-cleaning machine (not shown) so that heated solvent vapor-laden air can enter the housing 16 through the inlet port 68 and into the air inlet duct 38 where it is directed to the bottom of the housing 16 and through the opening 42 and into the cooling chamber 44 filled with pieces 78 of packing 80.

The tap water sprayed in fine droplets into the chamber 44 through the spray nozzle 56 and deflected by the packing 80 will absorb heat from the vapor-laden air so as to cool the vapor-laden air.

By the time the vapor-laden air reaches the top of the cooling chamber 44, a substantial amount of heat has been transferred to the tap water which then drains out a drain opening 86 at the bottom of the cooling chamber 44 into a drain pipe 88 in the column 18. The pipe 88 has a portion 89 thereof which forms a drain trap, which extends below an outlet pipe 90 and which is connected at a closed bottom end through a valve 92 to a faucet 94. Heavier-than-water solvent that may condense in the cooling chamber 44 will collect in this drain trap 89 and be drained off from time to time.

To insure that no solvent is entrained in the tap water exiting from the cooling chamber 44 through the outlet pipe 90, a window or gauge 95 can be in the pipe portion 89 just beneath the outlet pipe 90 so that an operator can visually see when the solvent has reached a level where it should be drained out from the faucet 94. The cooled solvent vapor-laden air reaching the top of the cooling chamber 44 will then flow out the outlet opening 46 through the transfer duct 40 and downwardly to the opening 48 which forms an air inlet to the condensing chamber 50.

The condensing chamber 50 has a plurality of corrugated condensing plates 96 which are arranged vertically in the condensing chamber 50. Such condensing plates 96 are typically of the type sold under the trademark PLASdek (PVC) by Muster Corporation of Fort Meyers, Fla.

Situated beneath the condensing chamber 50 is a separator/reservoir tank 100. A drain outlet 102 in the bottom of the condensing chamber 50 coupled to a drain pipe 104 feeds coolant and condensed solvent into the separator/reservoir tank 100.

Inside the separator/reservoir tank is a refrigeration coil 106 of a refrigeration unit 108 that also includes a compressor 110 and motor (not shown). It will be understood that the motor of the refrigeration unit 108 is operated to pump a refrigerant gas through the refrigeration coil 106 so that it can expand and take in heat from the liquid in the separator/reservoir tank 100.

Typically, the coolant is a brine solution of calcium chloride having a specific gravity of 1.20 to 1.35. The coolant can also be a solution of ethylene glycol and water or the solvent. The coolant (brine solution) is cooled by the refrigeration coil 106 in the separator/-reservoir tank 100 to a temperature between 20° F. and +20° F. and preferably to a temperature of −10° F.

From the tank 100, the coolant is pumped by a pump 112 through the conduit 67 to the spray nozzle 66 at the top of the condensing chamber 50 where the cooled coolant is sprayed into the condensing chamber 50 to create a film of coolant on the sides of the corrugated plates 96.

The cooled solvent vapor-laden air entering into the condensing chamber 50 and travelling upwardly through the interstices or spaces between the corrugated plates 96 and over the films of coolant thereon is condensed into the coolant and carried downwardly to the drain pipe 104 which feeds the mixture of coolant and solvent into the separator/reservoir tank 100.

According to one aspect of the present invention, a buoyant blanket 120 is situated on top of the liquid in the separator/reservoir tank 100 and serves a dual function.

Figure 5:
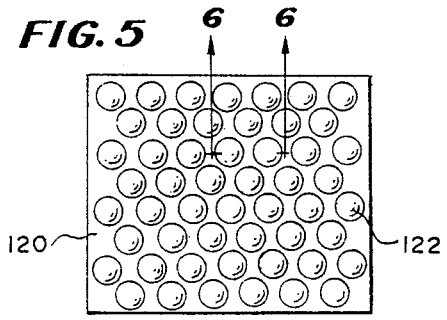
FIG. 5 is a top plan view of a blanket which is positioned in the separator/reservoir shown in FIGS. 1 and 2 above the liquid therein.
Figure 6:
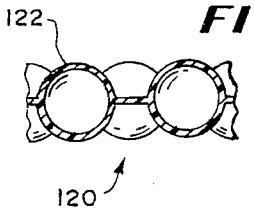
FIG. 6 is a sectional view of the blanket taken along line 6—6 of FIG. 5.

As shown in FIGS. 5 and 6, the blanket 120 is made from 2-plys of plastic material which are sealed together to form air pockets 122 therein in a quilt-like array in the blanket 120. Such a blanket 120 is sold under the trademark Sealed Air Solar Pool Blanket by the Sealed Air Corporation of Saddle Brook, N.J. Such a blanket 120 is typically used for preventing escape of heat from water in a swimming pool.

In the separator/reservoir tank 100, the blanket 120 serves the function of deflecting coolant and solvent flowing into the tank from the condensing chamber 50 and directing it outwardly toward the inside walls of the separator/reservoir tank 100. In this way, the incoming liquid mixture of coolant and solvent is not allowed to cause turbulence in the liquid mixture therebeneath By eliminating turbulence, thermoclimes are established in the separator/reservoir tank 100 such that the colder level is at the bottom and the warmest level is at the top with the heavier-than-water solvent settling to the bottom of the tank 100 as opposed to a mixing of the solvent with the coolant which could be caused by turbulence in the liquid mixture.

Additionally, the blanket 120 serves to insulate the liquid therebeneath and the refrigeration coil 106 therebeneath in the liquid from the ambient environment. Also, of course, a cover 124 is provided on the separator/reservoir tank for insulating purposes and the drain pipe 104 extends therethrough.

The tank 100 has a bottom outlet connected to a pipe 130 which extends upwardly along the side of the separator/reservoir tank 100 to an elbow and from there to an outlet pipe 132 leading back to a sump or reservoir for solvent utilized in the dry-cleaning machine(s) to which the apparatus 10 is attached and used.

Another outlet pipe 138 extends from the separator/-reservoir tank at a level above the solvent in the separator tank 100 and in communication with the cooled coolant (brine solution) that has been cooled by the refrigeration coil 106 in the separator/reservoir tank 100. This outlet pipe 138 is connected to a pump 140 as shown which pumps coolant through the conduit 67 to the spray nozzle 66.

In practicing the method of the present invention utilizing the apparatus 10 of the present invention, the outlet sleeve 74 is connected to a duct leading to the ambient air outside a building in which the dry-cleaning machines and the apparatus 10 are located. The inlet sleeve 72 is connected to a hot air outlet from the dry-cleaning machine(s) in the dry-cleaning plant. Hot solvent vapor-laden air is then fed through the inlet sleeve 72 through the inlet duct 38 into the bottom of the cooling chamber 44 where it flows upwardly and is cooled substantially by the droplets of tap water that are sprayed into the cooling chamber 44 and deflected within the chamber 44 by the tines 84. Then the cooled solvent vapor-laden air is passed from the top of the cooling chamber 44 downwardly through the transfer duct 40 through the opening 48 into the bottom of the condensing chamber 50 where it comes into contact with thin films of coolant on the plates 96 which are vertically arranged in the condensing chamber 50. As this solvent vapor-laden air passes upwardly over the films and in contact with some droplets of coolant which are sprayed into the top of the condensing chamber 50 by the spray nozzle 66, the solvent condenses into and with the coolant and flows downwardly with the coolant through the drain pipe 104 into the separator/reservoir tank 100. Here, the heavier-than-water solvent will settle to the bottom of the tank 100 while the coolant and solvent mixture is continually chilled by the refrigeration coil 106. Then the chilled coolant again is pumped out of the reservoir tank 100 and to the top of the housing 16 in conduit 67.

Continuously, or from time to time, solvent is withdrawn out of the outlet pipe 132 from the separator/-reservoir tank 100 and fed to a solvent reservoir for reuse.

Figure 2:
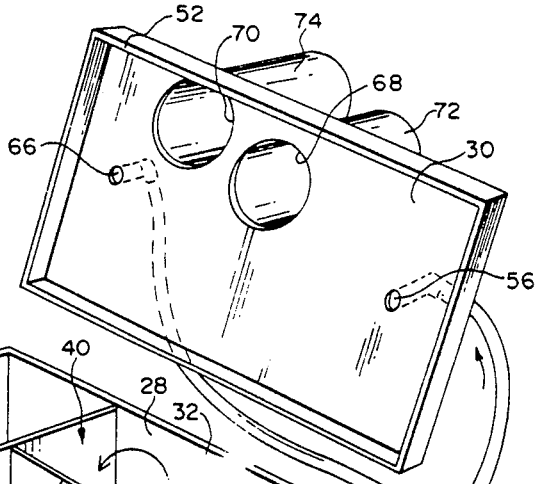
FIG. 2 is an enlarged perspective view of a portion of the apparatus shown in FIG. 1 with portions removed and broken away to better show the apparatus and how it is utilized in practicing the method.
Figure 2:
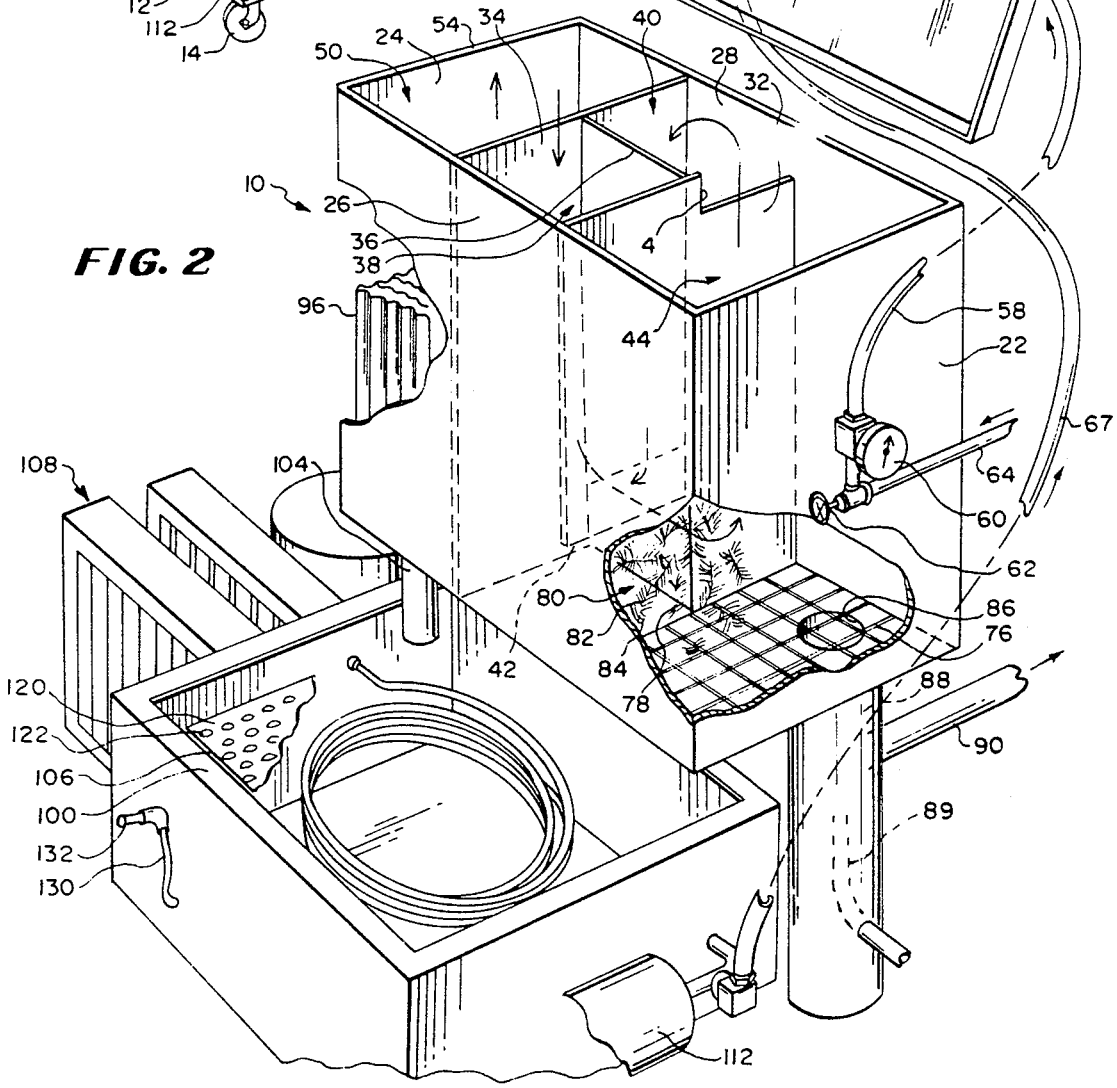
Figure 3:
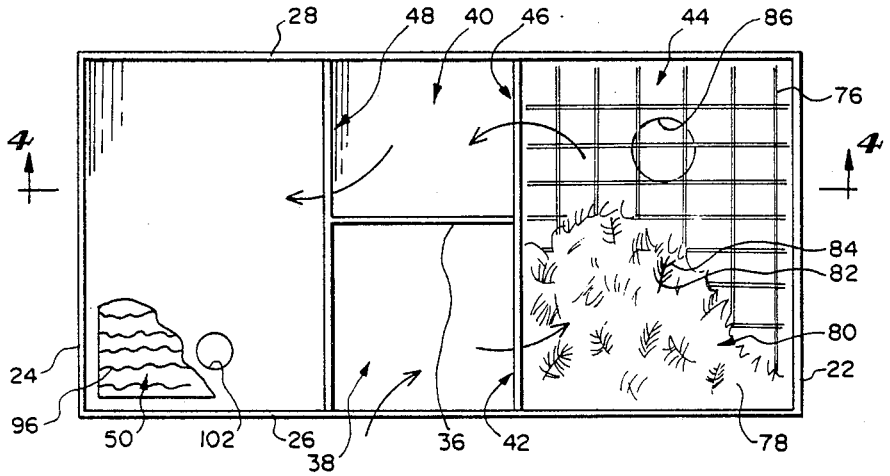
FIG. 3 is a top plan view of the housing of the apparatus shown in FIG. 2 with the cover removed and shows the flow of vapor-laden air therethrough.
Figure 4:
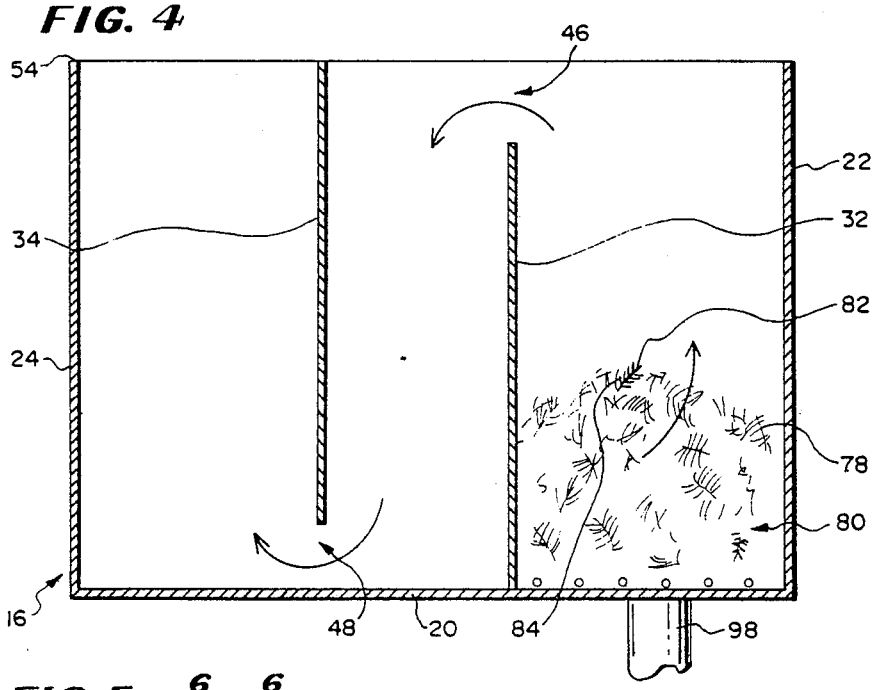
FIG. 4 is a sectional view taken along 4—4 of FIG. 3, and shows the flow of vapor-laden air through the housing.

Although FIGS. 3 and 4 show the cooling chamber only partly filled with packing 80, it is understood that the cooling chamber 44 is filled with packing 80 from the bottom to about six inches from the cover 30 to establish a spray area above the packing. Likewise, although FIG. 2 only shows the bottom half of the condensing chamber 50 having an array of parallel-spaced, corrugated plates 96 therein, it is understood that such plates 96 extend to about six inches from the cover 30 to establish a spray area above the plates 96.

From the foregoing description it will be appreciated that the method and apparatus of the present invention have a number of advantages, some of which have been described above and others of which are inherent in the invention.

Also, the method and apparatus can be used for removing various, e.g. hydocarbon, vapors from a gas and modifications can be made to the apparatus and method of the present invention without departing from the teachings of the invention. Accordingly, the scope of the invention is only to be limited as necessitated by the following claims.

I claim:

1. A method for recovering hydrocarbon and hydrocarbon derived solvents from solvent laden air including the steps of:

moving the solvent laden air through a first chamber, moving a film of liquid coolant, which liquid coolant is cooled to a temperature at least as low as 20° F. and is immiscible with the solvent to be recovered, over plates located in the first chamber in contact with the solvent laden air, thereby condensing the solvent on the film of liquid coolant moving over the plates, collecting the immiscible liquid coolant and condensed solvent, and:

separating the immiscible liquid coolant from the condensed solvent.

2. The method of claim 1 in which the solvent is perchloroethylene and the liquid coolant is a solution of ethylene glycol and water.

3. The method of claim 1 in which the solvent is perchloroethylene and the liquid coolant is a brine solution of calcium chloride.

4. The method of claim 1 in which the film of liquid coolant is moved through the first chamber in a direction counter to the direction of movement of the solvent laden air.

5. The method of claim 4 in which the solvent is perchloroethylene and the liquid coolant is a brine solution of calcium chloride.

6. The method of claim 1 in which the solvent is a dry cleaning solvent and the liquid coolant is a brine solution.

7. The method of claim 6 in which the solvent is perchloroethylene and the liquid coolant is a brine solution of calcium chloride.

* * * * *